US011676549B2

(12) United States Patent
Wang et al.

(10) Patent No.: US 11,676,549 B2
(45) Date of Patent: Jun. 13, 2023

(54) METHOD OF CONTROLLING DISPLAY OF DISPLAY DEVICE, APPARATUS THEREOF, AND DISPLAY APPARATUS

(71) Applicants: BOE MLED TECHNOLOGY CO., LTD., Beijing (CN); BOE TECHNOLOGY GROUP CO., LTD., Beijing (CN)

(72) Inventors: Mengmeng Wang, Beijing (CN); Xiurong Wang, Beijing (CN); Xiaomang Zhang, Beijing (CN); Wenhao Liu, Beijing (CN); Juanjuan Shi, Beijing (CN)

(73) Assignees: BOE MLED Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 71 days.

(21) Appl. No.: 17/252,388

(22) PCT Filed: May 25, 2020

(86) PCT No.: PCT/CN2020/091989

§ 371 (c)(1),
(2) Date: Dec. 15, 2020

(87) PCT Pub. No.: WO2020/259160

PCT Pub. Date: Dec. 30, 2020

(65) Prior Publication Data

US 2022/0189422 A1 Jun. 16, 2022

(30) Foreign Application Priority Data

Jun. 28, 2019 (CN) ..... 201910576806.8

(51) Int. Cl.
*G09G 3/34* (2006.01)
*G09G 3/00* (2006.01)

(52) U.S. Cl.
CPC ..... *G09G 3/3426* (2013.01); *G09G 3/006* (2013.01); *G09G 2320/0233* (2013.01);
(Continued)

(58) Field of Classification Search
CPC ..... G09G 3/3406–3426; G09G 3/006; G09G 2320/0233; G09G 2330/12;
(Continued)

(56) References Cited

U.S. PATENT DOCUMENTS 9,064,459 B2 6/2015 Ha et al.
9,224,361 B2 * 12/2015 Song ..... G09G 3/006
(Continued)

FOREIGN PATENT DOCUMENTS

CN 101425275 A 5/2009
CN 101493606 A 7/2009
(Continued)

*Primary Examiner* — Gene W Lee
(74) *Attorney, Agent, or Firm* — The Webb Law Firm

(57) ABSTRACT

The embodiments of the present application disclose a method of controlling display of a display device, an apparatus thereof and a display apparatus. The display device includes a backlight unit and a display panel, wherein the backlight unit includes a plurality of backlight partitions, each of which is independently driven, and the display panel includes a plurality of display partitions in one-to-one correspondence with the backlight partitions. The method comprises: causing the display panel to display a test image, wherein each pixel of the test image has a same gray value; acquiring a luminance of each display partition of the display panel; determining a compensation coefficient according to the luminance of each display partition; adjusting backlight data of the backlight partition according to the compensation coefficient to obtain adjusted backlight data of
(Continued)

each backlight partition; and providing the adjusted backlight data to the backlight unit for display by the display panel.

18 Claims, 6 Drawing Sheets

(52) U.S. Cl.
CPC ... *G09G 2330/12* (2013.01); *G09G 2360/141* (2013.01); *G09G 2360/16* (2013.01)

(58) Field of Classification Search
CPC .... G09G 2360/14–142; G09G 2360/145–148; G09G 2360/16
See application file for complete search history.

(56) References Cited

U.S. PATENT DOCUMENTS

| | | | | |
|---|---|---|---|---|
| 9,633,609 | B2 * | 4/2017 | Kao | G09G 3/3426 |
| 10,810,949 | B2 * | 10/2020 | Huang | G09G 3/3406 |
| 11,049,462 | B2 * | 6/2021 | Xiao | G02F 1/133606 |
| 2007/0247416 | A1 | 10/2007 | Chang et al. | |
| 2009/0109165 | A1 | 4/2009 | Park et al. | |
| 2009/0122227 | A1 | 5/2009 | Hong et al. | |
| 2009/0135195 | A1 | 5/2009 | Chen et al. | |
| 2011/0157242 | A1 | 6/2011 | Wang | |
| 2014/0022287 | A1 | 1/2014 | Ahn | |
| 2014/0204131 | A1 | 7/2014 | Chen et al. | |
| 2014/0210841 | A1 * | 7/2014 | Song | G09G 3/3625 345/589 |
| 2019/0213963 | A1 | 7/2019 | Zha | |
| 2019/0348001 | A1 | 11/2019 | Shi et al. | |
| 2019/0355316 | A1 | 11/2019 | Ji et al. | |

FOREIGN PATENT DOCUMENTS

| | | | |
|---|---|---|---|
| CN | 103077684 | A | 5/2013 |
| CN | 105869579 | A | 8/2016 |
| CN | 107204174 | A | 9/2017 |
| CN | 108428436 | A | 8/2018 |
| CN | 108470548 | A | 8/2018 |
| CN | 108648700 | A | 10/2018 |
| CN | 108766367 | A | 11/2018 |
| CN | 109064995 | A | 12/2018 |
| CN | 109920381 | A | 6/2019 |
| CN | 110189715 | A | 8/2019 |

* cited by examiner

METHOD OF CONTROLLING DISPLAY OF DISPLAY DEVICE, APPARATUS THEREOF, AND DISPLAY APPARATUS

CROSS REFERENCE TO RELATED APPLICATIONS

This application is the United States national phase of International Application No. PCT/CN2020/091989 filed May 25, 2020, and claims priority to Chinese Patent Application No. 201910576806.8 filed Jun. 28, 2019, the disclosures of which are hereby incorporated by reference in their entirety.

TECHNICAL FIELD

The present application relates to the technical field of display, and in particular, to a method of controlling display of a display device, an apparatus thereof and a display apparatus.

BACKGROUND

With the continuous development of display technologies, people have higher and higher requirements for display quality. An organic light-emitting diode display (OLED) has advantages of self-luminescence, high contrast, etc., but the OLED has problems of short lifetime, screen burn-in, and no resistance to humidity and heat. Therefore, a Liquid Crystal Display (LCD) that is technically mature and inexpensive is still the mainstream in the market. The LCD with a Mini LED backlight source and a local dimming algorithm, can achieve the advantages of high contrast and etc. of the OLED, and can overcome the defects of short lifetime and etc. of the OLED.

SUMMARY

The embodiments of the present application provide a method of controlling display of a display device, an apparatus thereof, and a display apparatus, capable of improving luminance uniformity in different backlight partitions and enhancing the display effect.

In a first aspect of the present application, there is provided a method of controlling display of a display device. The display device includes a backlight unit and a display panel, wherein the backlight unit includes a plurality of backlight partitions, each of which is independently driven, and the display panel includes a plurality of display partitions in one-to-one correspondence with the backlight partitions. The method comprises: causing the display panel to display a test image, wherein each pixel of the test image has a same gray value; acquiring a luminance of each display partition of the display panel; determining a compensation coefficient according to the luminance of each display partition; adjusting backlight data of the backlight partition according to the compensation coefficient to obtain adjusted backlight data of each backlight partition; and providing the adjusted backlight data to the backlight unit for display by the display panel.

In the embodiments of the present application, that determining a compensation coefficient according to the luminance of each display partition comprises: decoupling the luminance of each display partition to obtain a decoupled luminance of each display partition, wherein the decoupled luminance, compared to the luminance, eliminates an influence of the backlight partition not corresponding to the display partition to which the luminance belongs, on the luminance; and determining a ratio of a target luminance of each display partition to the decoupled luminance of each display partition as the compensation coefficient.

In the embodiments of the application, that adjusting backlight data of the backlight partition according to the compensation coefficient to obtain adjusted backlight data of each backlight partition comprises: multiplying the backlight data of the backlight partition by the compensation coefficient.

In the embodiments of the present application, the target luminance is determined by: setting a same intermediate target luminance for each display partition, wherein the intermediate target luminance is selected to be greater than or equal to a maximum value of the luminance and less than or equal to a minimum value of the luminance; and decoupling the intermediate target luminance to obtain the target luminance, wherein the target luminance, compared to the intermediate target luminance, eliminates an influence of the backlight partition not corresponding to the display partition to which the intermediate target luminance belongs, on the intermediate target luminance.

In the embodiments of the present application, the intermediate target luminance is selected to be equal to the minimum value of the luminance.

In the embodiments of the present application, the target luminance is determined by: grouping the display partitions according to the decoupled luminance, wherein the display partitions in each group are adjacent to each other and have the decoupled luminance within a predetermined range, wherein the decoupled luminance within the predetermined range is perceived by human eyes as being the same; and if a number of the display partitions in each group does not exceed a predetermined number, determining an average of the decoupled luminance of the display partitions outside of but directly adjacent to the group as the target luminance for each display partition in the group; and if the number of the display partitions in each group exceeds the predetermined number, taking the decoupled luminance of each display partition in the group as its target luminance.

In the embodiments of the present application, the predetermined number depends on a size of the backlight partitions and a size of the display panel.

In the embodiments of the present application, the predetermined number is 15.

In the embodiments of the present application, that acquiring the luminance of each display partition of the display panel comprises: acquiring a panel image of the display panel; dividing the panel image into a plurality of panel image partitions in one-to-one correspondence with the display partitions; for each panel image partition, calculating an average of gray values of all pixels in the panel image partition; and taking the average as the luminance of the display partition corresponding to the panel image partition.

In a second aspect of the present application, there is provided an apparatus for controlling display of a display device. The display device includes a backlight unit and a display panel, wherein the backlight unit includes a plurality of backlight partitions, each of which is independently driven, and the display panel includes a plurality of display partitions in one-to-one correspondence with the backlight partitions. The apparatus comprises: one or more processors; a memory coupled to the processor and storing computer program instructions, wherein the computer program instructions, when executed by the processor, cause the apparatus to: cause the display panel to display a test image, wherein each pixel of the test image has a same gray value;

acquire a luminance of each display partition of the display panel; determine a compensation coefficient according to the luminance of each display partition; adjust backlight data of the backlight partition according to the compensation coefficient to obtain adjusted backlight data of each backlight partition; and provide the adjusted backlight data to the backlight unit for display by the display panel.

In the embodiments of the present application, the computer program instructions, when executed by the processor, cause the apparatus to determine the compensation coefficient according to the luminance of each display partition by: decoupling the luminance of each display partition to obtain a decoupled luminance of each display partition, wherein the decoupled luminance, compared to the luminance, eliminates an influence of the backlight partition not corresponding to the display partition to which the luminance belongs, on the luminance; and determining a ratio of a target luminance of each display partition to the decoupled luminance of each display partition as the compensation coefficient.

In the embodiments of the present application, the computer program instructions, when executed by the processor, cause the apparatus to adjust the backlight data of the backlight partition according to the compensation coefficient by: multiplying the backlight data of the backlight partition by the compensation coefficient.

In the embodiments of the present application, the computer program instructions, when executed by the processor, cause the apparatus to determine the target luminance by: setting a same intermediate target luminance for each display partition, wherein the intermediate target luminance is selected to be greater than or equal to a maximum value of the luminance and less than or equal to a minimum value of the luminance; and decoupling the intermediate target luminance to obtain the target luminance, wherein the target luminance, compared to the intermediate target luminance, eliminates an influence of the backlight partition not corresponding to the display partition to which the intermediate target luminance belongs, on the intermediate target luminance.

In the embodiments of the present application, the computer program instructions, when executed by the processor, cause the intermediate target luminance to be selected to be equal to the minimum value of the luminance.

In the embodiments of the present application, the computer program instructions, when executed by the processor, cause the apparatus to determine the target luminance by: grouping the display partitions according to the decoupled luminance, wherein the display partitions in each group are adjacent to each other and have the decoupled luminance within a predetermined range, wherein the decoupled luminance within the predetermined range is perceived by human eyes as being the same; and if a number of the display partitions in each group does not exceed a predetermined number, determining an average of the decoupled luminance of the display partitions outside of but directly adjacent to the group as the target luminance for each display partition in the group; and if the number of the display partitions in each group exceeds the predetermined number, taking the decoupled luminance of each display partition in the group as its target luminance.

In the embodiments of the present application, the predetermined number depends on a size of the backlight partition and a size of the display panel.

In the embodiments of the present application, the predetermined number is 15.

In the embodiments of the present application, the computer program instructions, when executed by the processor, cause the apparatus to acquire the luminance of each display partition of the display panel by: acquiring a panel image of the display panel; dividing the panel image into a plurality of panel image partitions in one-to-one correspondence with the display partitions; for each panel image partition, calculating an average of gray values of all pixels in the panel image partition; and taking the average as the luminance of the display partition corresponding to the panel image partition.

According to a third aspect of the present application, there is provided a display apparatus. The display apparatus includes: a display device; and the apparatus according to the second aspect of the present application, coupled to the display device.

According to a fourth aspect of the present application, there is provided a computer readable storage medium having stored thereon computer program instructions, which, when executed by a processor, cause the processor to perform the method described above.

Further aspects and scopes of adaptability will become apparent from the description provided herein. It should be understood that various aspects of the present application may be implemented alone or in combination with one or more other aspects. It should also be understood that the description and specific embodiments herein are intended for illustration only and are not intended to limit the scope of the present disclosure.

BRIEF DESCRIPTION OF THE DRAWINGS

The drawings described herein are for the purpose of illustrating only the selected embodiments but not for all possible implementations, and are not intended to limit the scope of the present disclosure, wherein.

DETAILED DESCRIPTION

To make the objectives, technical solutions and advantages of the embodiments of the present application more clear, the technical solutions of the embodiments of the present application will be described clearly and completely below in conjunction with the accompanying drawings of the embodiments of the present application. Evidently, the described embodiments are only a few embodiments of the present application, and not all embodiments. All other embodiments, which can be derived by one of ordinary skill in the art from the described embodiments of the application without inventive efforts, are within the scope of protection of the present application. The embodiments of the present application will be described in detail below with reference to the accompanying drawings in conjunction with the embodiments. It should be noted that, features in the embodiments of the present application may be combined with each other without conflict.

The local dimming technique may divide an entire backlight unit into a plurality of individually drivable backlight partitions, each of which includes one or more LED backlight sources (e.g., Mini-LED). During display, the backlight unit obtains backlight data of each backlight partition depending on gray values of different parts of a displayed image, and generates a driving signal (e.g., voltage) for the LED backlight source of the corresponding backlight partition based on the backlight data, thereby achieving individual adjustment of a luminance of each backlight partition, and further, improving the contrast of the displayed image. However, due to the influence of factors such as manufacturing process deviation and driving mode of the LEDs, it is difficult to ensure luminance uniformity in different backlight partitions, thereby affecting final display effect.

Figure 1:
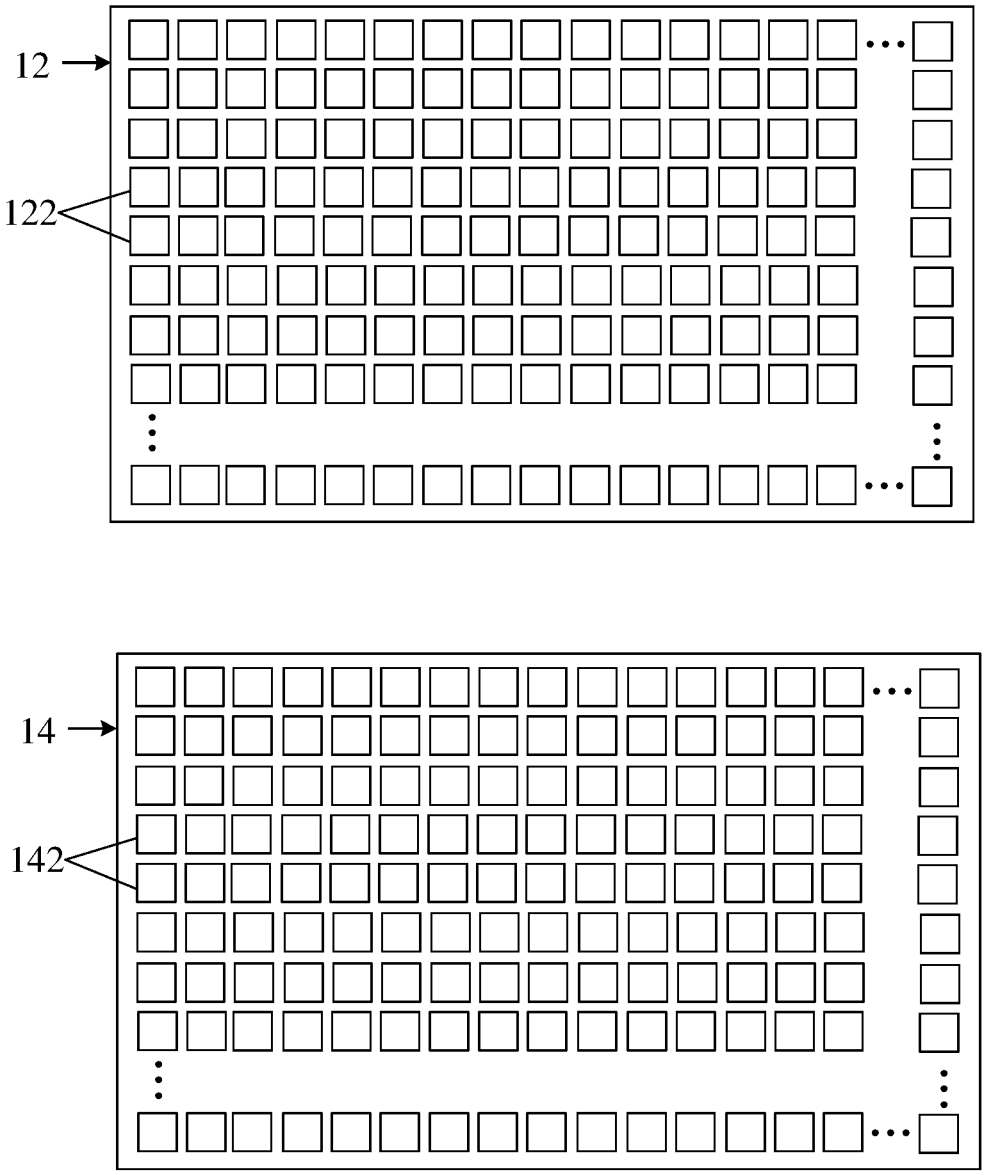
FIG. 1 is a schematic block diagram of a display device according to the embodiments of the present application.

FIG. 1 is a schematic block diagram of a display device 10 according to the embodiments of the present application. As shown in FIG. 1, the display device 10 may include a backlight unit 12 and a display panel 14. The backlight unit 12 may include M×N backlight partitions 122, each of which may be independently driven. The display panel 14 may include M×N display partitions 142 in one-to-one correspondence with the backlight partitions 122. In the present application, "backlight partitions in one-to-one correspondence with the display partitions" refers to that a projection of the backlight partition on the display panel coincides with the display partition.

Figure 2:
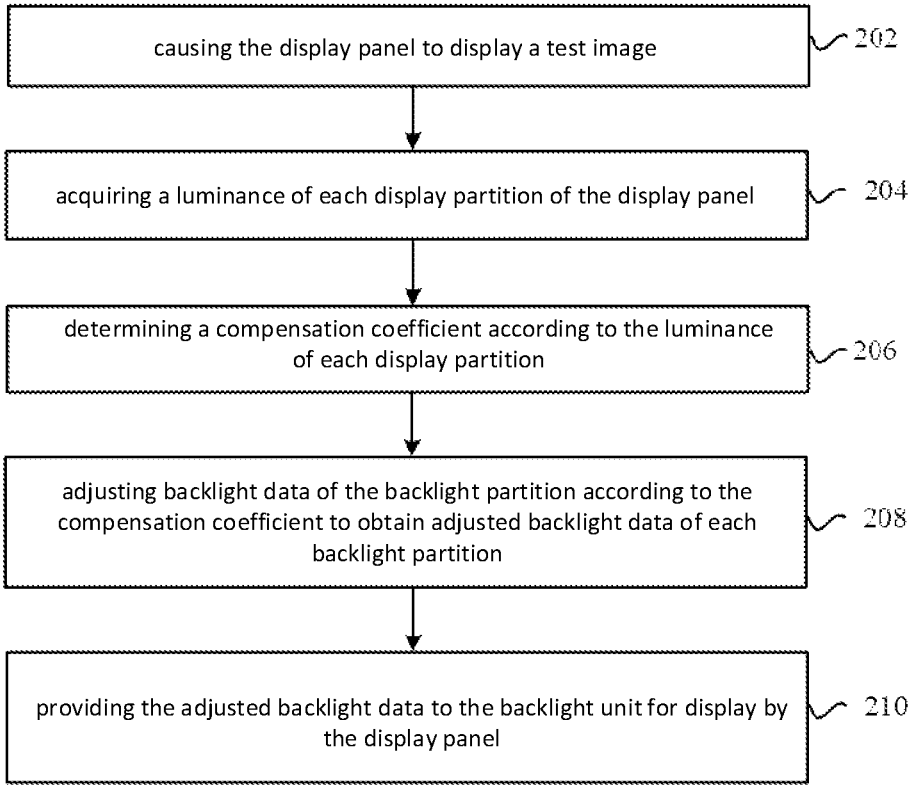
FIG. 2 is a schematic flowchart of a method of controlling display of the display device shown in FIG. 1 according to the embodiments of the present application.

FIG. 2 is a schematic flowchart of a method of controlling display of the display device shown in FIG. 1 according to the embodiments of the present application.

As shown in FIG. 2, in block 202, the display panel is caused to display a test image. Each pixel of the displayed test image may have a same gray value. In the embodiments of the present application, the gray value of each pixel may be 255, i.e., the test image may be a white image. It should be understood that the gray value of each pixel may also be other values.

Figure 3A:
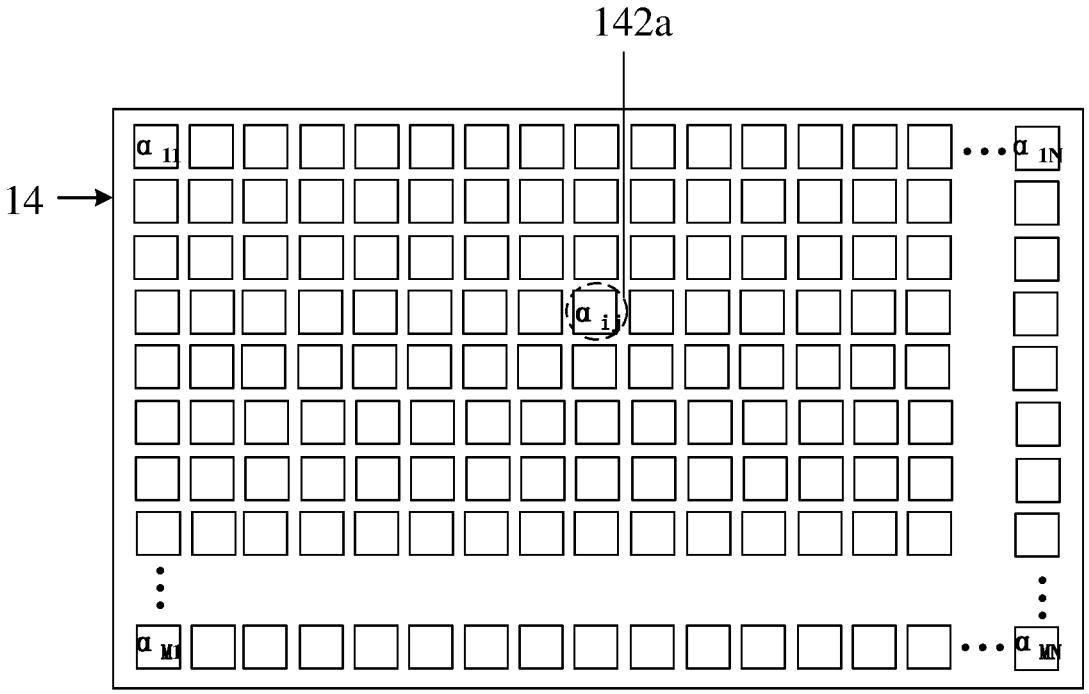
FIG. 3A is a schematic diagram showing a luminance of each display partition of the display panel shown in FIG. 1.

In block 204, a luminance of each display partition of the display panel is acquired. How to acquire the luminance of the display partition will be described in detail below. First, a panel image of the display panel captured by an image capturing device (e.g., a camera) is acquired. In the present application, the panel image is an effect image actually displayed when the display panel displays according to data of the test image. Then, the panel image may be divided into a plurality of panel image partitions in one-to-one correspondence with the display partitions. In the present application, "panel image partitions in one-to-one correspondence with the display partitions" refers to that a projection of the panel image partition on the display panel coincides with the display partition. Then, for each panel image partition, an average of gray values of all pixels therein may be calculated. Finally, the average is taken as the luminance of the display partition corresponding to the panel image partition. FIG. 3A is a schematic diagram showing a luminance of each display partition of the display panel shown in FIG. 1, and as shown in FIG. 3A, $\alpha_{ij}$ represents a luminance of a display partition in a ith row and jth column, where $1 \le i \le M$, and $1 \le j \le N$, and N are positive integers greater than 2.

Figure 3B:
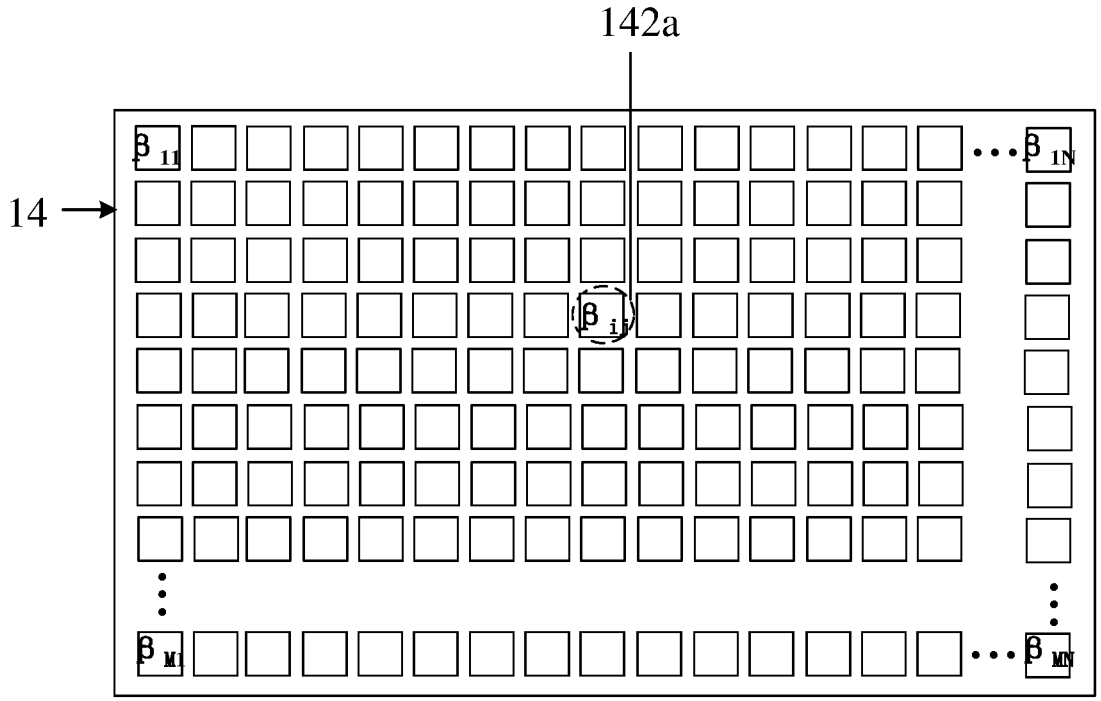
FIG. 3B is a schematic diagram showing a decoupled luminance obtained by decoupling the luminance of the display partition shown in FIG. 3A.

In block 206, a compensation coefficient is determined according to the luminance of each display partition. The process of determining the compensation coefficient will be described in detail below. Firstly, the luminance of the display partition is decoupled to obtain the decoupled luminance of the display partition. In the embodiments of the present application, the display partition 142*a* in the ith row and the jth column in the display panel 14 shown in FIG. 3A is taken as an example for the description of the decoupling process. Since light emitted from each LED backlight source in the backlight unit may generate light diffusion, the light emitted from LED backlight sources located at different positions all contributes to the luminance $\alpha_{ij}$ of the display partition 142*a*. The closer the LED backlight source to the display partition 142*a*, the greater the influence of the light emitted from the LED backlight source on the luminance $\alpha_{ij}$ of the display partition 142*a*. Therefore, the luminance $\alpha_{ij}$ of the display partition 142*a* needs to be decoupled to obtain a decoupled luminance of the display partition 142*a*. For example, the method of Feng Li et al. (see the paper "Deriving LED Driving Signal for Area-Adaptive LED Backlight in High Dynamic Range LCD Displays" of Feng Li et al., Advanced Display, No. 81, 2007) can be adopted for decoupling. It should be understood that the decoupled luminance may also be obtained according to other conventional methods in the art. FIG. 3B is a schematic diagram showing a decoupled luminance obtained by decoupling the luminance of the display partition shown in FIG. 3A, and as shown in FIG. 3B, $\beta_{ij}$ represents a decoupled luminance of the display partition in the ith row and jth column, where $1 \le i \le N$, $1 \le j \le N$, and M and N are positive integers greater than or equal to 2. According to the embodiments of the present application, the decoupled luminance $\beta_{ij}$ shown in FIG. 3B eliminates an influence of the backlight partition not corresponding to the display partition 142*a* to which the luminance $\alpha_{ij}$ belongs on the luminance $\alpha_{ij}$, compared to the luminance $\alpha_{ij}$ of the display partition 142*a* shown in FIG. 3A.

Figure 3C:
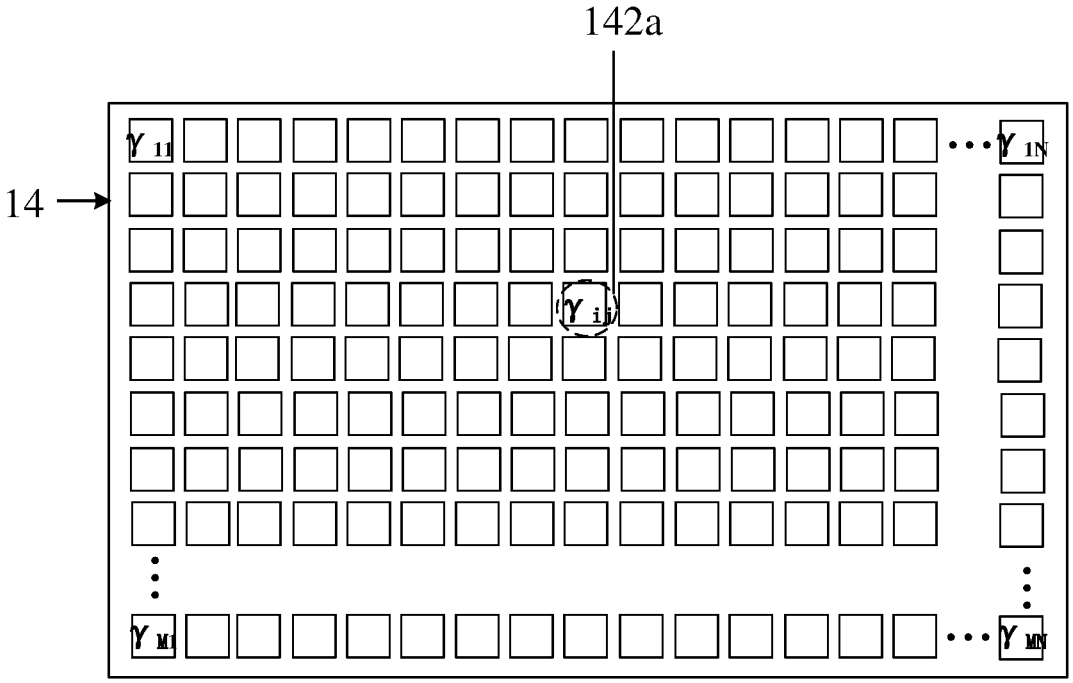
FIG. 3C is a schematic diagram showing a target luminance for each display partition.

After obtaining the decoupled luminance of each display partition, a ratio of the target luminance of the display partition to the decoupled luminance of the display partition is determined as a compensation coefficient. FIG. 3C shows a schematic diagram of the target luminance of each display partition, and as shown in FIG. 3C, $\gamma_{ij}$ represents the target luminance of the display partition in the ith row and jth column, where $1 \le i \le M$, $1 \le j \le N$, and M and N are positive integers greater than 2. In the embodiments of the present application, for the display partition 142*a*, its compensation coefficient is $\gamma_{ij}/\beta_{ij}$. How to determine the target luminance will be described in detail below.

Figure 4:
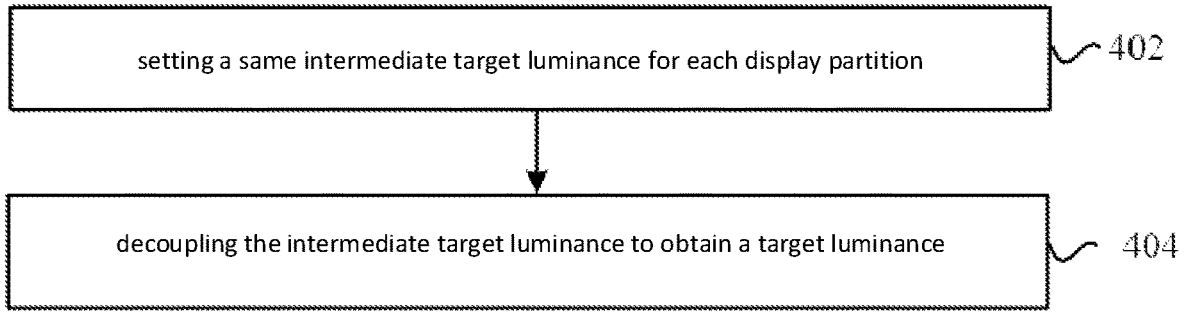
FIG. 4 is a schematic flowchart for determining the target luminance according to an embodiment of the present application.

FIG. 4 is a schematic flowchart for determining the target luminance according to an embodiment of the present application. As shown in FIG. 4, in block 402, a same intermediate target luminance is set for each display partition. In the embodiments of the present application, one of the luminance $\alpha_{ij}$ of the display partitions shown in FIG. 3A may be selected as the intermediate target luminance $\gamma'$. For example, the intermediate target luminance $\gamma'$ may be selected as a minimum value $\alpha_{min}$. Next, in block 404, the intermediate target luminance γ' is decoupled to obtain the target luminance $\gamma_{ij}$ shown in FIG. 3C. In the embodiments of the present application, the decoupling process of the intermediate target luminance is similar to that of the luminance of the display partition, and the description is not repeated herein. By means of the decoupling process, the target luminance eliminates an influence of the backlight partition not corresponding to the display partition to which the intermediate target luminance belongs, on the intermediate target luminance, compared to the intermediate target luminance.

Figure 5:
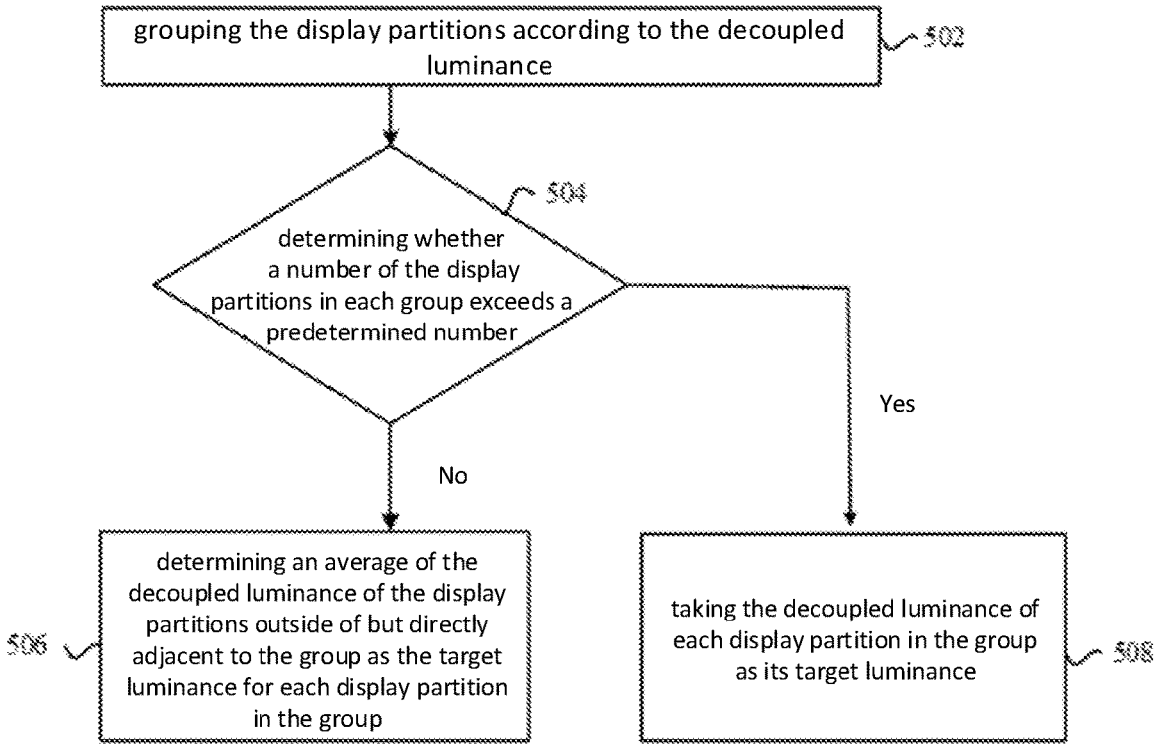
FIG. 5 is a schematic flowchart for determining the target luminance according to another embodiment of the present application.
Figure 6:
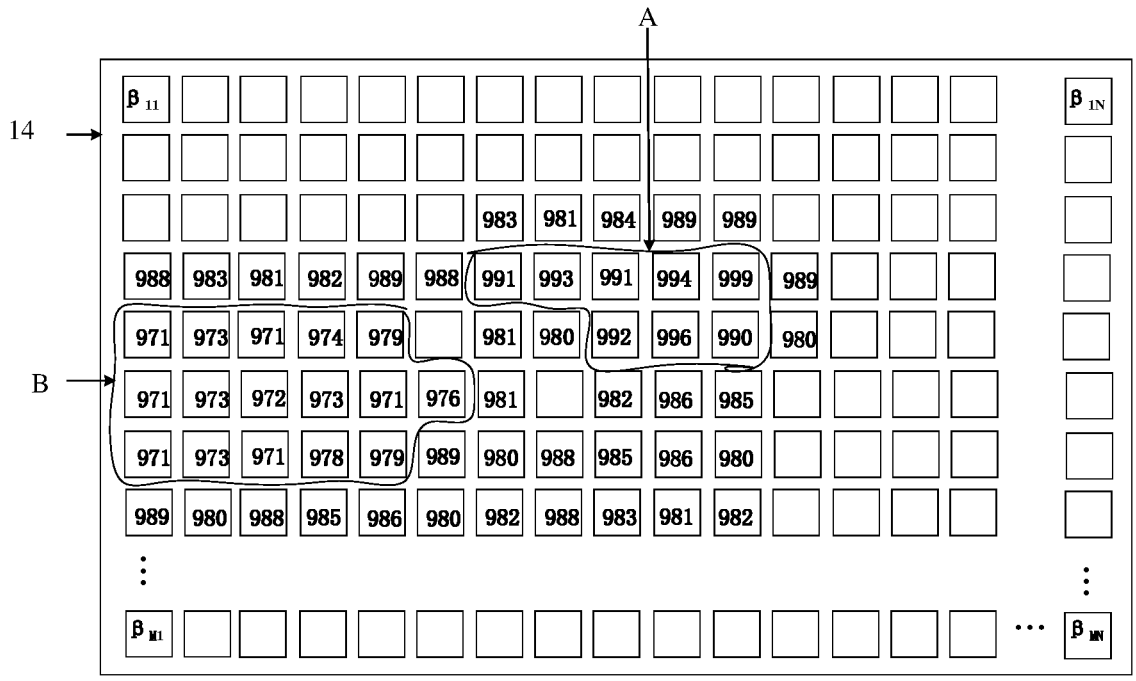
FIG. 6 is a schematic diagram showing grouping of the display partitions according to the embodiments of the present application.

FIG. 5 is a schematic flowchart for determining the target luminance according to another embodiment of the present application. As shown in FIG. 5, in block 502, the display partitions are grouped according to the decoupled luminance. Specifically, first, the decoupled luminance may be divided into a plurality of predetermined ranges, each of which cannot be clearly distinguished by human eyes, in other words, the decoupled luminance within the predetermined range is perceived by the human eyes as being the same. In one example, if a minimum value $\beta_{min}$ of the decoupled luminance of the display partitions is 970 nit and a maximum value $\beta_{max}$ thereof is 1000 nit, the decoupled luminance may be divided into, for example, the following three predetermined ranges: a first predetermined range from 1000 nit to 990 nit, a second predetermined range from 989 nit to 980 nit and a third predetermined range from 979 nit to 970 nit. Then, the display partitions adjacent to each other and within the same predetermined range are grouped into a same group. In the case of the above example, FIG. 6 is a schematic diagram showing grouping of the display partitions. As shown in FIG. 6, the decoupled luminance of a portion of the display partitions of the display panel is assigned to a specific value. Group A may comprise 8 display partitions adjacent to each other, and the decoupled luminance thereof is within the first predetermined range from 1000 nit to 990 nit; group B may comprise 16 display partitions adjacent to each other, and the decoupled luminance thereof is within the third predetermined range from 979 nit to 970 nit; and the decoupled luminance of a portion of the display partitions outside of group A and group B is within the second predetermined range from 989 nit to 980 nit.

continuously with reference to FIG. 5, in block 504, it is determined whether a number of the display partitions in each group exceeds a predetermined number. The predetermined number may be depended on the size of the backlight partitions and the overall size of the display panel. Each backlight partition, for example, includes one or more independently driven LED lamps. For example, the predetermined number may be an empirically derived number of 15. If the predetermined number is not exceeded, in block 506, an average of the decoupled luminance of the display partitions outside of but directly adjacent to the group is determined and taken as a target luminance for each display partition in the group. In this application, the display partitions outside of but directly adjacent to the group refer to no other display partitions between the display partitions and at least one display partition in the group. As shown in FIG. 6, the number of the display partitions in group A does not exceed 15, and the average of the decoupled luminance of the display partitions directly adjacent to group A=(983+981+984+989+989+989+980+985+986+982+980+981+988)/13984, and the average 984 is taken as the target luminance for the 8 display partitions in group A.

Continuously with reference to FIG. 5, if in block 504 it is determined that the number of the display partitions in each group exceeds the predetermined number, the flow goes to block 508 in which, the decoupled luminance of each display partition in the group is taken as its target luminance. For example, as shown in FIG. 6, the number of the display partitions in group B exceeds 15, and the target luminance of the 16 display partitions in group B is their respective decoupled luminance.

It can be seen from the embodiment that, if the number of display partitions in a group exceeds a predetermined number, the decoupled luminance thereof can be directly taken as a target luminance, without the need of calculating an average of the decoupled luminance of the display partitions outside of but directly adjacent to the group, which can increase the operation speed and reduce the operation time.

For clarity, FIG. 6 only shows grouping of a portion of the display partitions of the display panel, and it will be understood that other portions of the display partitions of the display panel may also be grouped according to the method shown in FIG. 5, and a target luminance of each display partition is determined.

According to the embodiments of the present application, the steps described in the blocks 202 to 206 may be completed in the manufacturing stage of the display panel, or at any suitable time according to the needs of users. Furthermore, the compensation coefficient determined by the step 206 may be stored in a memory, e.g. in the display panel, for use in subsequent steps.

Continuously with reference to FIG. 2, in block 208, the backlight data of the backlight partition are adjusted according to the compensation coefficient to obtain adjusted backlight data of each backlight partition. In the embodiments of the present application, the backlight data of the backlight partition may be multiplied by the compensation coefficient, and the product may be taken as the adjusted backlight data.

In block 210, the adjusted backlight data are provided to the backlight unit, and the backlight unit generates driving signals for different backlight partitions according to the adjusted backlight data, and outputs these driving signals to corresponding backlight partitions to drive LED backlight sources in these backlight partitions to emit light, so as to cause the display panel to display. It will be appreciated that the image displayed in accordance with the adjusted backlight data is the actually displayed image, and the image may be the same as or different from a test image.

It should be noted that, for any image to be actually displayed by a display device, backlight data of the backlight partitions can be adjusted according to the determined compensation coefficient, without the need of determining different compensation coefficients for different images.

It can be seen from the above description that, with the use of the method according to the embodiments of the present application, by adjusting the backlight data of the backlight partitions according to the determined compensation coefficients, it is able to improve luminance uniformity in different backlight partitions and enhance the display effect, without changing the structure of the backlight unit, the film material, and the backlight driving mode, thereby providing better visual experience for users.

The flow chart shown in FIG. 2 is for illustration only and those skilled in the art will appreciate that various modifications may be made to the flowchart shown or the steps described therein.

Figure 7:
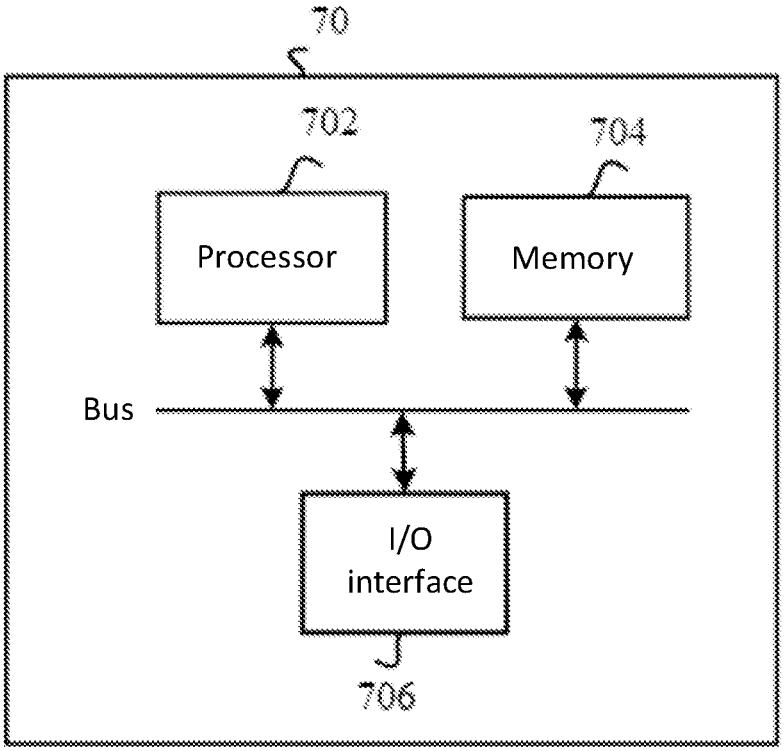
FIG. 7 is a schematic block diagram of an apparatus for controlling display of a display device according to the embodiments of the present application.

FIG. 7 is a schematic block diagram of an apparatus 70 for controlling display of a display device according to the embodiments of the present application. As shown in FIG. 7, the apparatus 70 includes one or more processors 702 and a memory 704. The memory 704 is coupled to the processor 702 via a BUS and an I/O interface 706 and stores computer program instructions.

When the computer program instructions are executed by the processor 702, the apparatus 70 may cause a display panel to display a test image. Each pixel of the test image has a same gray value. The apparatus 70 may also acquire a luminance of each display partition of the display panel. The apparatus 70 may determine a compensation coefficient according to the luminance of each display partition. The apparatus 70 may further adjust backlight data of the backlight partition according to the compensation coefficient to obtain adjusted backlight data of each backlight partition. Finally, the apparatus 70 may provide the adjusted backlight data to the backlight unit for display by the display panel.

In the embodiments of the present application, that determining, by the apparatus 70, the compensation coefficient according to the luminance of each display partition may comprise: decoupling the luminance of each display partition to obtain a decoupled luminance of each display partition, wherein the decoupled luminance, compared to the luminance, eliminates an influence of the backlight partition not corresponding to the display partition to which the luminance belongs, on the luminance; and determining a ratio of a target luminance of each display partition to the decoupled luminance of each display partition as the compensation coefficient.

In the embodiments of the present application, that adjusting, by the apparatus 70, backlight data of the backlight partition according to the compensation coefficient may comprise: multiplying the backlight data of the backlight partition by the compensation coefficient.

In the embodiments of the present application, that determining, by the apparatus 70, the target luminance may comprise: setting a same intermediate target luminance for each display partition, wherein the intermediate target luminance is selected to be greater than or equal to a maximum value of the luminance and less than or equal to a minimum value of the luminance; and decoupling the intermediate target luminance to obtain the target luminance, wherein the target luminance, compared to the intermediate target luminance, eliminates an influence of the backlight partition not corresponding to the display partition to which the intermediate target luminance belongs, on the intermediate target luminance.

In the embodiments of the present application, the apparatus 70 may select the intermediate target luminance to be equal to the minimum value of the luminance.

In the embodiments of the present application, that determining, by the apparatus 70, the target luminance may comprise: grouping the display partitions according to the decoupled luminance, wherein the display partitions in each group are adjacent to each other and have the decoupled luminance within a predetermined range, wherein the decoupled luminance within the predetermined range is perceived by human eyes as being the same; and if the number of the display partitions in each group does not exceed a predetermined number, determining an average of the decoupled luminance of the display partitions outside of but directly adjacent to the group as the target luminance for each display partition in the group; and if the number of the display partitions in each group exceeds the predetermined number, the decoupled luminance of each display partition in the group is taken as its target luminance.

In the embodiments of the present application, the predetermined number is 15.

In the embodiments of the present application, the apparatus 70 may be implemented as a separate apparatus or may be integrated in the display device.

As can be seen from the above description, with the use of the apparatus according to the embodiments of the present application, by adjusting backlight data of the backlight partitions according to the determined compensation coefficients, it is able to improve luminance uniformity in different backlight partitions and enhance the display effect and provide better visual experience for users, without changing the structure of the backlight unit, the film material, and the backlight driving mode.

Figure 8:
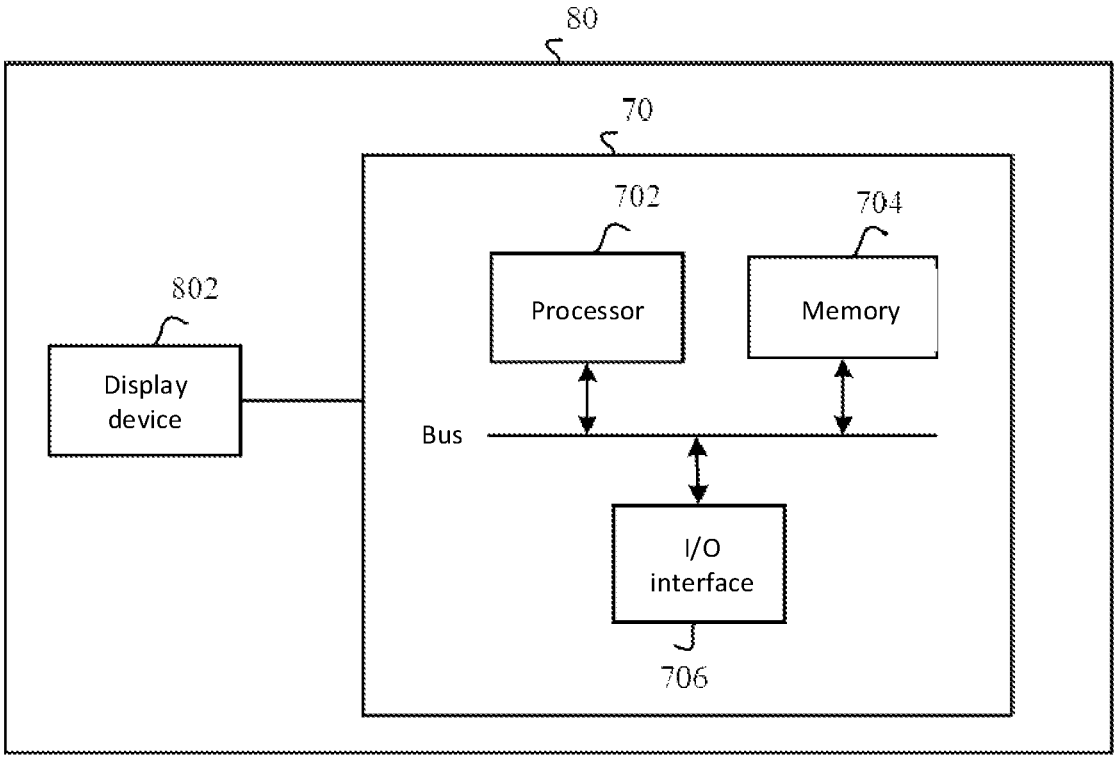
FIG. 8 is a schematic block diagram of a display apparatus according to the embodiments of the present application.

FIG. 8 is a schematic block diagram of a display apparatus 80 according to the embodiments of the present application. As shown in FIG. 8, the display apparatus 80 may include a display device 802, and the apparatus 70 shown in FIG. 7, coupled to the display device 802.

In the embodiments of the present application, the display apparatus includes, for example, but is not limited to, various electronic devices having a display screen. The display apparatus may be: any product or component with a display function, such as a liquid crystal panel, electronic paper, an OLED panel, a mobile phone, a tablet computer, a television set, a display, a notebook computer, a digital photo frame, a navigator.

According to the embodiments of the application, by adjusting backlight data of the backlight partitions according to the determined compensation coefficients, it is able to improve luminance uniformity in different backlight partitions and enhance the display effect without changing the structure of the backlight unit, the film material, and the backlight driving mode, thereby providing better visual experience for users.

The above description is only for preferred embodiments of the present application and is not intended to limit the present application, and various modifications and variations may be made to the present application by those skilled in the art. Any modification, equivalent replacement, or improvement made within the spirit and principle of the present application shall be included in the protection scope of the present application.

What is claimed is:

1. A method of controlling display of a display device including a backlight unit and a display panel, wherein the backlight unit includes a plurality of backlight partitions, each of which is independently driven, and the display panel includes a plurality of display partitions in one-to-one correspondence with the backlight partitions, the method comprising:

causing the display panel to display a test image, wherein each pixel of the test image has a same gray value;

acquiring a luminance of each display partition of the display panel;

determining a compensation coefficient according to the luminance of each display partition;

adjusting backlight data of the backlight partition according to the compensation coefficient to obtain adjusted backlight data of each backlight partition; and providing the adjusted backlight data to the backlight unit for display by the display panel, wherein determining a compensation coefficient according to the luminance of each display partitions comprises:

decoupling the luminance of each display partition to obtain a decoupled luminance of each display partition, wherein the decoupled luminance, compared to the luminance, eliminates an influence of backlight partitions not corresponding to the display partition to which the luminance belongs, on the luminance; and determining a ratio of a target luminance of each display partition to the decoupled luminance of each display partitions as the compensation coefficient.

2. The method according to claim 1, wherein that adjusting backlight data of the backlight partition according to the compensation coefficient to obtain adjusted backlight data of each backlight partition comprises:

multiplying the backlight data of the backlight partition by the compensation coefficient.

3. The method according to claim 1, wherein the target luminance is determined by:

setting a same intermediate target luminance for each display partition, wherein the intermediate target luminance is selected to be greater than or equal to a maximum value of the luminance and less than or equal to a minimum value of the luminance; and decoupling the intermediate target luminance to obtain the target luminance, wherein the target luminance, compared to the intermediate target luminance, eliminates an influence of backlight partitions not corresponding to the display partition to which the intermediate target luminance belongs, on the intermediate target luminance.

4. The method according to claim 3, wherein the intermediate target luminance is selected to be equal to the minimum value of the luminance.

5. The method according to claim 1, wherein the target luminance is determined by:

grouping the display partitions according to the decoupled luminance, wherein the display partitions in each group are adjacent to each other and have the decoupled luminance within a predetermined range, wherein the decoupled luminance within the predetermined range is perceived by human eyes as being the same; and if a number of the display partitions in each group does not exceed a predetermined number, determining an average of the decoupled luminance of the display partitions outside of but directly adjacent to the group as the target luminance for each display partition in the group; and if the number of the display partitions in each group exceeds the predetermined number, taking the decoupled luminance of each display partition in the group as its target luminance.

6. The method according to claim 5, wherein the predetermined number depends on a size of the backlight partitions and a size of the display panel.

7. The method according to claim 5, wherein the predetermined number is 15.

8. The method according to claim 1, wherein that acquiring the luminance of each display partition of the display panel comprises:

acquiring a panel image of the display panel;

dividing the panel image into a plurality of panel image partitions in one-to-one correspondence with the display partitions;

for each panel image partition, calculating an average of gray values of all pixels in the panel image partition; and taking the average as the luminance of the display partition corresponding to the panel image partition.

9. A non-transitory computer-readable storage medium having stored thereon computer program instructions, which, when executed by a processor, cause the processor to perform the method according to claim 1.

10. An apparatus for controlling display of a display device including a backlight unit and a display panel, wherein the backlight unit includes a plurality of backlight partitions, each of which is independently driven, and the display panel includes a plurality of display partitions in one-to-one correspondence with the backlight partitions, the apparatus comprising:

one or more processors;

a memory coupled to the processor and storing computer program instructions, wherein the computer program instructions, when executed by the processor, cause the apparatus to:

cause the display panel to display a test image, wherein each pixel of the test image has a same gray value;

acquire a luminance of each display partition of the display panel;

determine a compensation coefficient according to the luminance of each display partition;

adjust backlight data of the backlight partition according to the compensation coefficient to obtain adjusted backlight data of each backlight partition; and provide the adjusted backlight data to the backlight unit for display by the display panel, wherein the computer program instructions, when executed by the processor, cause the apparatus to determine the compensation coefficient according to the luminance of each display partition by:

decoupling the luminance of each display partition to obtain a decoupled luminance of each display partition, wherein the decoupled luminance, compared to the luminance, eliminates an influence of backlight partitions not corresponding to the display partition to which the luminance belongs, on the luminance; and determining a ratio of a target luminance of each display partition to the decoupled luminance of each display partitions as the compensation coefficient.

11. The apparatus according to claim 10, wherein the computer program instructions, when executed by the processor, cause the apparatus to determine the target luminance by:

grouping the display partitions according to the decoupled luminance, wherein the display partitions in each group are adjacent to each other and have the decoupled luminance within a predetermined range, wherein the decoupled luminance within the predetermined range is perceived by human eyes as being the same; and if a number of the display partitions in each group does not exceed a predetermined number, determining an average of the decoupled luminance of the display partitions outside of but directly adjacent to the group as the target luminance for each display partition in the group; and if the number of the display partitions in each group exceeds the predetermined number, taking the decoupled luminance of each display partition in the group as its target luminance.

12. The apparatus according to claim 10, wherein the computer program instructions, when executed by the processor, cause the apparatus to adjust the backlight data of the backlight partition according to the compensation coefficient by:

multiplying the backlight data of the backlight partition by the compensation coefficient.

13. The apparatus according to claim 10, wherein the computer program instructions, when executed by the processor, cause the apparatus to determine the target luminance by:

setting a same intermediate target luminance for each display partition, wherein the intermediate target luminance is selected to be greater than or equal to a maximum value of the luminance and less than or equal to a minimum value of the luminance; and decoupling the intermediate target luminance to obtain the target luminance, wherein the target luminance, compared to the intermediate target luminance, eliminates an influence of backlight partitions not corresponding to the display partition to which the intermediate target luminance belongs, on the intermediate target luminance.

14. The apparatus according to claim 13, wherein the computer program instructions, when executed by the processor, cause the intermediate target luminance to be selected to be equal to the minimum value of the luminance.

15. The apparatus according to claim 14, wherein the predetermined number depends on a size of the backlight partition and a size of the display panel.

16. The apparatus according to claim 14, wherein the predetermined number is 15.

17. The apparatus according to claim 10, wherein that acquiring the luminance of each display partition of the display panel comprises:

acquiring a panel image of the display panel;

dividing the panel image into a plurality of panel image partitions in one-to-one correspondence with the display partitions;

for each panel image partition, calculating an average of gray values of all pixels in the panel image partition; and taking the average as the luminance of the display partition corresponding to the panel image partition.

18. A display apparatus, comprising:

a display device; and the apparatus according to claim 10, coupled to the display device.

* * * * *